US006092720A

United States Patent [19]

Karolyi

[11] Patent Number: 6,092,720

[45] Date of Patent: Jul. 25, 2000

[54] FOLDED CARDBOARD BLANK DISH-SHAPED CONTAINER

[75] Inventor: Oskar Karolyi, Bad Boll, Germany

[73] Assignee: Michael Hoerauf Maschinenfabrik GmbH & Co. KG, Germany

[21] Appl. No.: 09/227,259

[22] Filed: Jan. 8, 1999

[30] Foreign Application Priority Data

Jan. 21, 1998 [DE] Germany ..... 198 02 051

[51] Int. Cl.[7] ..... B65D 5/24

[52] U.S. Cl. ..... 229/169; 229/170; 229/186

[58] Field of Search ..... 229/125.35, 169, 229/170, 186, 188

[56] References Cited

U.S. PATENT DOCUMENTS

| | | | |
|---|---|---|---|
| 3,550,835 | 12/1970 | Persson | 229/125.35 |
| 3,606,078 | 9/1971 | Phillips, Jr. | 229/170 |
| 4,114,797 | 9/1978 | Manizza | 229/169 |
| 4,130,236 | 12/1978 | Manizza | 229/186 |
| 4,308,985 | 1/1982 | Manizza et al. | 229/125.35 |
| 4,533,079 | 8/1985 | Persson | 229/170 |
| 4,687,130 | 8/1987 | Beller | 229/188 |
| 4,718,596 | 1/1988 | Muller et al. | 229/186 |
| 4,721,040 | 1/1988 | Mau | 229/186 |
| 4,944,451 | 7/1990 | Forbes, Jr. | 229/125.35 |
| 4,951,868 | 8/1990 | Mode | 229/186 |
| 4,998,669 | 3/1991 | Karolyi . | |
| 5,433,374 | 7/1995 | Forbes, Jr. | 229/125.35 |

*Primary Examiner*—Gary E. Elkins
*Attorney, Agent, or Firm*—Evenson McKeown Edwards & Lenahan P.L.L.C.

[57] ABSTRACT

A dish-shaped container is made from a folded cardboard blank sealable on both sides. The container has a rectangular bottom and four upfolded lateral panels which are connected to the container corners respectively by four triangular-shaped corner panels. A circumferential double-walled outer flange parallel to the bottom consists of first and second outer strips. The first outer strips are folded on the respective lateral panel, and the second outer strips are aligned with their cut edges towards the outer surface of the respective lateral panels. The first outer strips extend continuously over the entire periphery of the container, so that there are no breaks up to the filler area. The second outer strips are left out in the area of the corner panels. As a result of the double layer, the container comprises a reinforced outer flange and is in addition absolutely impermeable to liquids in the corner areas.

3 Claims, 4 Drawing Sheets

FOLDED CARDBOARD BLANK DISH-SHAPED CONTAINER

This application claims the priority of German application No. 198 02 051.1, filed Jan. 21, 1998, the disclosure of which is expressly incorporated by reference herein.

BACKGROUND OF THE INVENTION

The present invention relates to a dish-shaped container made of a folded cardboard blank sealable on both sides, comprising a rectangular-shaped bottom and four upfolded lateral panels, which are connected to the container corners by a plurality of essentially triangular corner panels. An outer circumferential flange parallel to the bottom is predominantly double-walled, and essentially formed from first and second outer strips. The first outer strips are folded onto the respective lateral panels, and the second outer strips, folded onto the first outer strips, are aligned with their cut edges towards the outer surface of the respective lateral panels.

U.S. Pat. No. 4,998,669 discloses a container which has a reinforced outer flange, so that even in the case of very thin cardboard, the container is sufficiently stable, whereby this outer flange extends parallel to the bottom. Thereby, the container can be closed by a flat membrane or a paper sheet. A disadvantage of this approach is, however, that neither the first nor the second outer strips extend over the corner panels, on which only very narrow supporting panels are folded. The indentations of the cardboard blanks extending to the filler space lead to the closed container not always being sufficiently impermeable at the container corners.

SUMMARY OF THE INVENTION

An object of the present invention is to form a container which is absolutely impermeable at the container corners, while maintaining the above mentioned advantages.

This object has been achieved in accordance with the present invention in that four almost identical corner panels are arranged to each container corner. Two corner panels are folded on top of the other, and the first outer strips extend continuously also over the corner panels. The second outer strips are left out in the area of the corner panels, apart from a triangular extension directly at the container corners.

As a result of folding the first and second outer strips over one another, a double-walled flange is achieved in the area of the lateral panels. The flange provides sufficient stability for the container and permits the container to be closed by a flat membrane or a paper sheet. A double-walled part of the circumferential outer flange is also achieved by folding over the triangular-shaped panels at the container corners. As the first outer strips extend without interruption also over the corner panels, there are no indentations which reach the filler area. This results in the container being absolutely impermeable in its corner areas.

The double walls of the outer flange in the area of the coiner panels, i.e., there where the second outer strips are left out, come about due to the folding of two corners panels over one another, which then are folded onto a relevant end piece of the lateral panels disposed underneath. Due to the corner panels being folded over one another, the first outer strips present are also folded over together with the corner panels, so that the outer flange is three-layered in this area. In particular when a sufficiently thin cardboard is chosen, which is reinforced by the multilayered outer flange, there are no disadvantages when in the area of the corner panels the outer flange has a third additional wall.

The production of the container of the present invention is particularly simple to carry out when a plane intermediate segment is provided. This arises in that, in the plane cardboard blank which is previously provided with folding lines, the second outer strips, including the triangular-shaped extensions, are folded over into said partly completed double-walled outer flange. The formation of the dish-shaped container occurs thus in two stages: first, the flat intermediate segment is produced from the cardboard blank, whereby the outer flange is already partly completed in its double-walled form; subsequently, the flat intermediate segment is fed to a simple erecting machine which can be directly connected to a filling machine. This division into two production stages permits the material supplier to be able to previously supply the intermediate segments.

BRIEF DESCRIPTION OF THE DRAWINGS

These and further objects, features and advantages of the present invention will become more readily apparent from the following detailed description thereof when taken in conjunction with the accompanying drawings wherein.

DETAILED DESCRIPTION OF THE DRAWINGS

Figure 1:
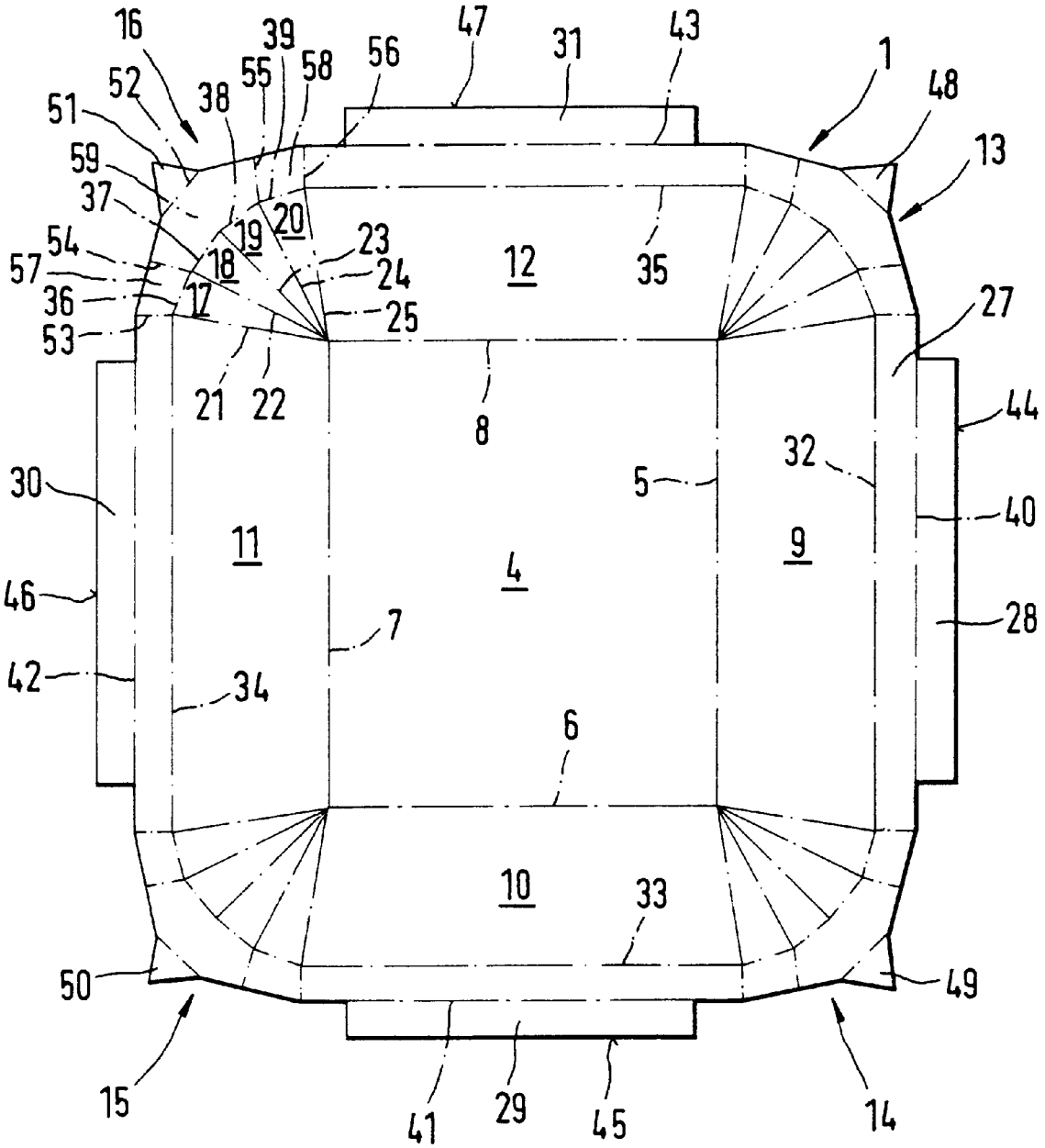
FIG. 1 is a flat laid cardboard blank from which the dish-shaped container of the present invention is to be folded.

The cardboard blank designated generally by the numeral 1 consists of paper coated on both sides with plastic and therefore sealable on both sides. The grooved folding lines are shown by dot-dash lines. In a first procedural stage, an intermediate segment 2 (FIG. 2) is formed from the cardboard blank 1. This intermediate segment is described in more detail below, and from this intermediate segment 2, in turn, is formed the dish-shaped container 3.

The rectangular bottom 4 is defined by folding lines 5, 6, 7 and 8. The lateral panels 9, 10, 11 and 12 bordering the bottom 4 can be folded up along these folding lines 5, 6, 7 and 8. At the subsequent container corners designated generally by numerals 13, 14, 15 and 16, each two adjacent lateral panels are connected by four, identically shaped, essentially triangular corner panels 17, 18, 19 and 20 to one another. The corner panels 17, 18, 19, 20 are separated from each other by folding lines 22, 23 and 24 and adjoin the corresponding lateral panels 11, 12 by folding 1 lines 21, 25.

In the subsequent folding process, the corner panels 17, 18 are folded over one another in such a way that the corner, panel 18 is visible on the inside of the subsequently finished container 3 and covers, together with the underlying corner panel 17, the outer part of the lateral panel 11. The corner panels 19, 20 are accordingly folded over one another such that the corner panel 19 is visible from the inside of the finished container 3 and, together with the underlying corner panel 20, covers the outer part of the lateral panel 12.

Figure 2:
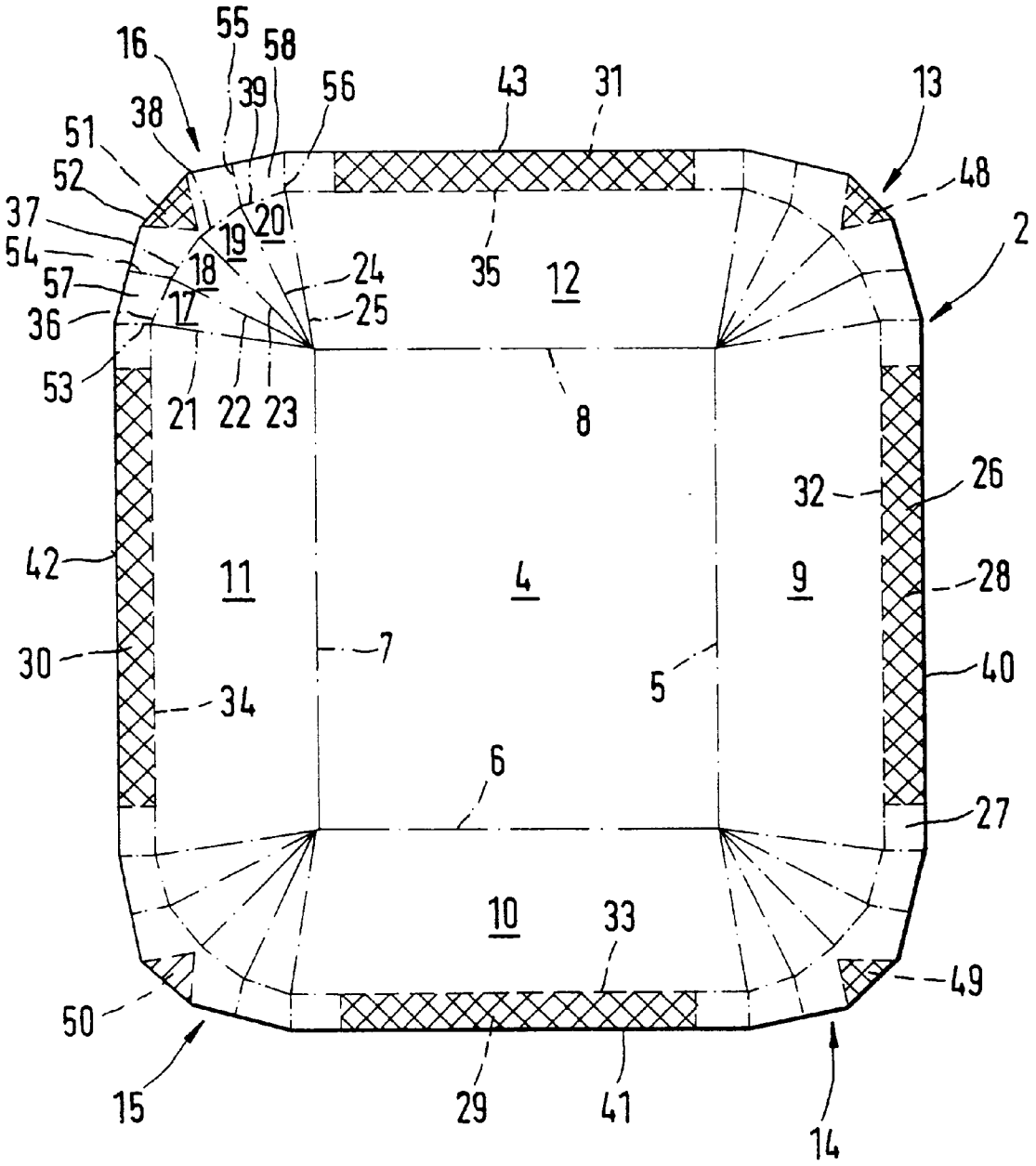
FIG. 2 is a flat laid intermediate segment made from the cardboard blank of FIG. 1, in which part of the double-walled form of the outer flange (see crosshatched area) is already produced by folding the second outer strips and the triangular extensions at the container corners.
Figure 3:
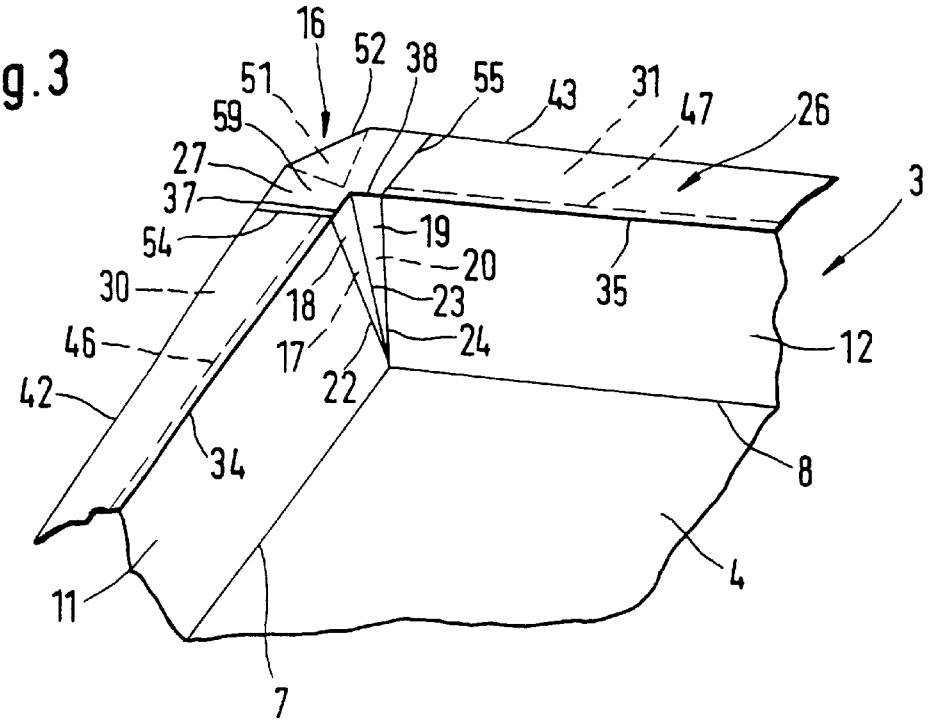
FIG. 3 is a perspective top view onto the container inside in the area of a container corner.
Figure 4:
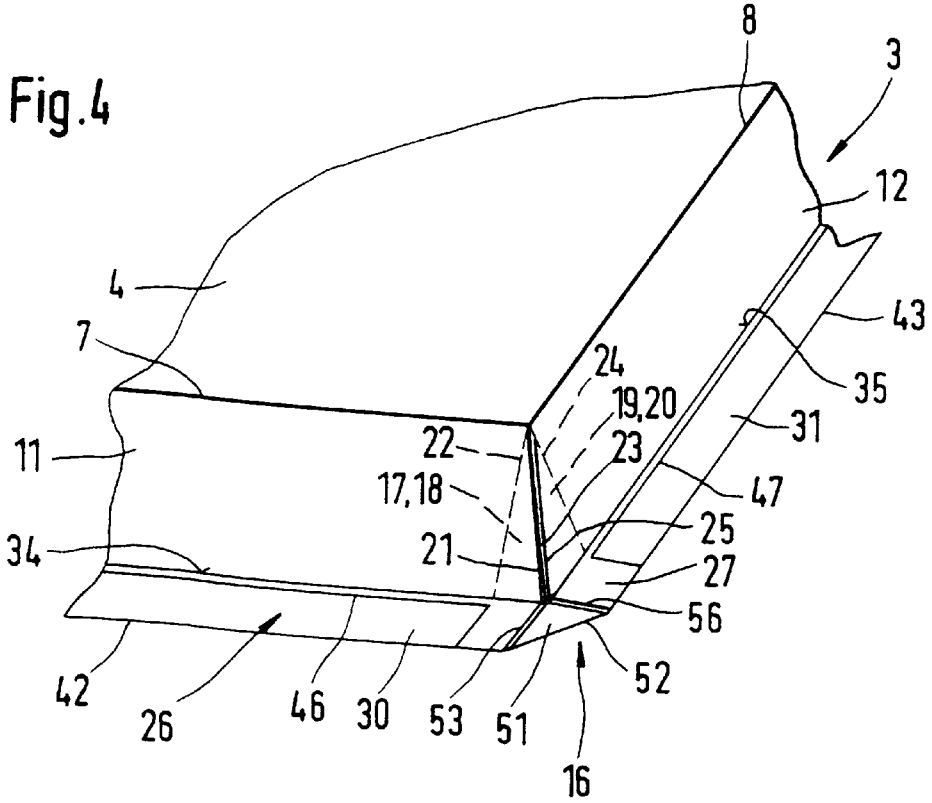
FIG. 4 is a perspective bottom view of the container exterior in the area of a container corner.
Figure 5:
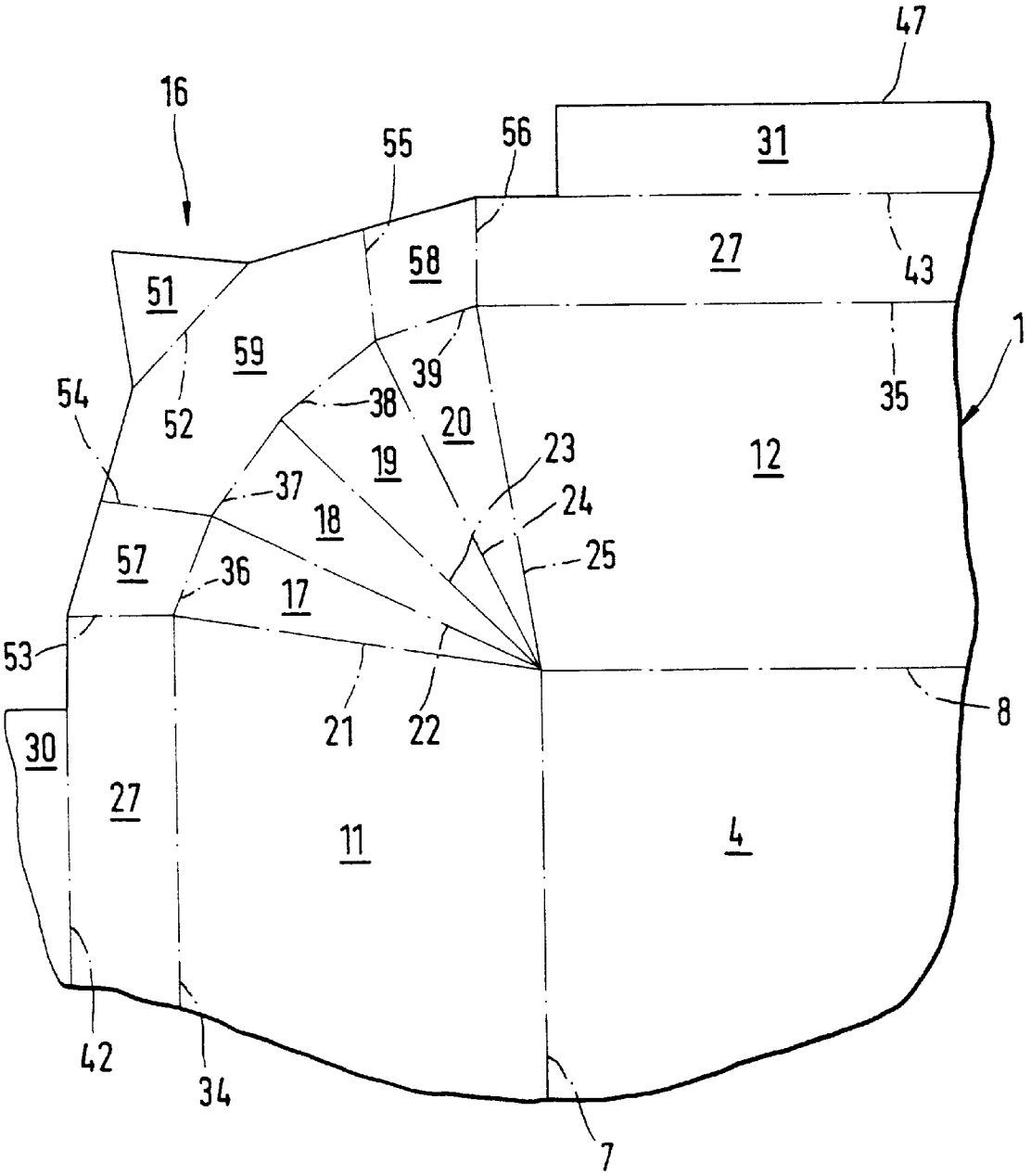
FIG. 5 is a greatly enlarged part view of FIG. 1 in the area of a container corner.

As seen in FIG. 2, the container 3 achieves a predominantly double-walled outer flange 26 parallel to the bottom 4 so that a flat membrane or a paper sheet can be applied as a closing element. The outer flange 26 comprises a first outer strip 27 which is continuous around the entire periphery of the container and somewhat wider in the area of the container corners 13, 14, 15 and 16. The first outer strip 27 is defined relative to the lateral panels 9, 10, 11 and 12 by folding lines 32, 33, 34 and 35. The parts 57, 58 and 59 of the first outer strip 27 (as seen in FIG. 5) are separated relative to the corner panels 17, 18, 19 and 20 by folding lines 36, 37, 38 and 39.

Four second outer strips 28, 29, 30 and 31 border the circumferential first outer strip 27 by way of folding lines 40, 41, 42 and 43. The second outer strips 28, 29, 30 and 31 are left out in the area of the container corners 13, 14, 15 and 16. After folding over has produced the double-walled outer flange 26, which is already the case with the intermediate segment 2 (FIG. 2), the cut edges 44, 45, 46 and 47 are aligned towards the outer surfaces of the respective lateral panels 9, 10, 11 and 12.

In the area of each of the container corners 13, 14, 15 and 16, as seen in FIG. 2, triangular extensions 48, 49, 50 and 51 are foldable along folding lines 52 and thus make the outer flange 26 also double-walled at the container corners 13, 14, 15 and 16.

The circumferential first outer strip 27 is separated from the corner panels 17, 18, 19 and 20 by way of folding lines 53, 54, 55 and 56. These folding lines 53 to 56 extend to a certain extent the folding lines 21, 22, 24 and 25. This gives rise to two relatively narrow outer panels 57, 58, as well as to a somewhat larger intermediate panel 59 (FIG. 5). As a result of folding over the corner panels 17, 18, on one hand, as well as 19, 20, on the other hand, a three-walled form occurs in the subsequent outer flange 56 in the area of the original outer panels 57, 58 and is interrupted only at the four extensions 48 to 51, where the outer flange 26 is only double-walled.

When the container corners 13, 14, 15, 16 are folded, the outer panel 57 is folded a small bit onto that part of the first outer strip 27 which borders the lateral panel 11. In a corresponding way, the outer panel 58 is folded a small bit over the first outer strip 27 which borders the lateral panel 12. In the area of this folding over, the second outer strips 28, 29, 30, 31 are still left out. In the area of the outer panels 57, 58, the outer flange 26 must be particularly carefully sealed, as there exists here a triple-walled form, and because the outer flange 26 is somewhat extended in the area of the intermediary panel 59. As a result of the type of chosen or selected folding, the circumferential outer flange 26 is not geometrically absolutely exact and must be compensated for by certain expansive properties of the cardboard blank 1 in this area.

As already mentioned above, the intermediate segment 2 is first made from the cardboard blank 1, in which the second outer strips 28, 29, 30, 31, as well as the triangular extensions 48, 49, 50, 51, are already folded over. Together, they form, with the first outer strip 27, a partly completed outer flange 26. This partly completed outer flange 26 can be previously sealed onto the plane intermediate segment 2 which is then, as described above, folded to the container 3. Thereby, by way of the particular embodiment, especially as applied to the container corners 13, 14, 15, 16, it is ensured that no indentations whatsoever reach what will be the subsequent filled space. The container 3 is thus absolutely leak-proof also at the container corners 13, 14, 15, 16.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A folded, dish-shaped container made of a cardboard blank sealable on both sides, comprising: a rectangular bottom, four folded up lateral panels which are connectable with the bottom, four container corners, four approximately similar triangular corner panels which, at each container corner, corner panels are connected with the relevant lateral panels, whereby two corner panels of each are folded onto one another, and a circumferential, substantially double-walled outer flange parallel to the bottom and formed substantially of first outer strips and second outer strips, wherein the first outer strips are foldable at the respective lateral panel and extend break-free along the corner panels, and the second outer strips foldable onto the first outer strips are alignable with cut edges thereof towards an outer surface of the respective lateral panel and, apart from a triangular extension at the directly adjoining corners, are left out in the area of the corner panels.

2. A plane intermediate segment for producing a container made of a cardboard blank sealable on both sides, comprising: a rectangular bottom, four folded up lateral panels which are connectable with the bottom, four container corners, four approximately similar triangular corner panels which, at each container corner, corner panels are connected with the relevant lateral panels, whereby two corner panels of each are folded onto one another, and a circumferential, substantially double-walled outer flange parallel to the bottom and formed substantially of first outer strips and second outer strips, wherein the first outer strips are foldable at the respective lateral panel and extend break-free along the corner panels, and the second outer strips foldable onto the first outer strips are alignable with cut edges thereof towards an outer surface of the respective lateral panel and, apart from a triangular extension at the directly adjoining corners, are left out in the area of the corner panels, wherein the plane cardboard blank is provided with folding lines, and the second outer strips, including the triangular formed extensions, are folded over to a partly completed double-walled outer flange.

3. The intermediate segment according to claim 2, wherein the outer flange (26) is previously sealed.

* * * * *